US006940967B2

(12) United States Patent
Makinen et al.

(10) Patent No.: US 6,940,967 B2
(45) Date of Patent: Sep. 6, 2005

(54) MULTIRATE SPEECH CODECS

(75) Inventors: Jari Makinen, Tampere (FI); Janne Vainio, Lempäälä (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/804,099

(22) Filed: Mar. 19, 2004

(65) Prior Publication Data

US 2005/0143984 A1 Jun. 30, 2005

(30) Foreign Application Priority Data

Nov. 11, 2003 (GB) ..... 0326262

(51) Int. Cl.[7] ..... G10L 19/00
(52) U.S. Cl. ..... 379/387.01; 704/227; 704/229; 379/387.02
(58) Field of Search ..... 375/240.24; 704/227, 704/229, 201, 219, 258

(56) References Cited

U.S. PATENT DOCUMENTS

| | | | | |
|---|---|---|---|---|
| 6,647,366 | B2 * | 11/2003 | Wang et al. | 704/201 |
| 2003/0135372 | A1 * | 7/2003 | Zinser et al. | 704/258 |
| 2004/0002856 | A1 * | 1/2004 | Bhaskar et al. | 704/219 |
| 2005/0055203 | A1 * | 3/2005 | Makinen et al. | 704/229 |

* cited by examiner

*Primary Examiner*—Sinh Tran
*Assistant Examiner*—Walter F Briney, III
(74) *Attorney, Agent, or Firm*—Squire, Sanders & Dempsey LLP

(57) ABSTRACT

A method of determining a codec mode for encoding a frame in a communications system, the method comprising the steps of: receiving a sequence of signal samples arranged in frames; analysing a current frame to select a codec mode appropriate for the current frame; predicting the characteristics of a subsequent frame using lookahead samples from the subsequent frame; and determining a codec mode for the current frame and the subsequent frame which suits the current frame and also suits a subsequent frame based on the predicted characteristics.

19 Claims, 4 Drawing Sheets

MULTIRATE SPEECH CODECS

FIELD OF INVENTION

The present invention relates to speech encoding in a communication system.

BACKGROUND TO THE INVENTION

Cellular communication networks are commonplace today. Cellular communication networks typically operate in accordance with a given standard or specification. For example, the standard or specification may define the communication protocols and/or parameters that shall be used for a connection. Examples of the different standards and/or specifications include, without limiting to these, GSM (Global System for Mobile communications), GSM/EDGE (Enhanced Data rates for GSM Evolution), AMPS (American Mobile Phone System), WCDMA (Wideband Code Division Multiple Access) or 3rd generation (3G) UMTS (Universal Mobile Telecommunications System), IMT 2000 (International Mobile Telecommunications 2000) and so on.

In a cellular communication network, voice data is typically captured as an analogue signal, digitised in an analogue to digital (A/D) converter and then encoded before transmission over the wireless air interface between a user equipment, such as a mobile station, and a base station. The purpose of the encoding is to compress the digitised signal and transmit it over the air interface with the minimum amount of data whilst maintaining an acceptable signal quality level. This is particularly important as radio channel capacity over the wireless air interface is limited in a cellular communication network. The sampling and encoding techniques used are often referred to as speech encoding techniques or speech codecs.

Often speech can be considered as bandlimited to between approximately 200 Hz and 3400 Hz. The typical sampling rate used by a A/D converter to convert an analogue speech signal into a digital signal is either 8 kHz or 16 kHz. The sampled digital signal is then encoded, usually on a frame by frame basis, resulting in a digital data stream with a bit rate that is determined by the speech codec used for encoding. The higher the bit rate, the more data is encoded, which results in a more accurate representation of the input speech frame. The encoded speech can then be decoded and passed through a digital to analogue (D/A) converter to recreate the original speech signal.

An ideal speech codec will encode the speech with as few bits as possible thereby optimising channel capacity, while producing decoded speech that sounds as close to the original speech as possible. In practice there is usually a trade-off between the bit rate of the codec and the quality of the decoded speech.

In today's cellular communication networks, speech encoding can be divided roughly into two categories: variable rate and fixed rate encoding.

In variable rate encoding, a source based rate adaptation (SBRA) algorithm is used for classification of active speech. Speech of differing classes are encoded by different speech modes, each operating at a different rate. The speech modes are usually optimised for each speech class. An example of variable rate speech encoding is the enhanced variable rate speech codec (EVRC).

In fixed rate speech encoding, voice activity detection (VAD) and discontinuous transmission (DTX) functionality is utilised, which classifies speech into active speech and silence periods. During detected silence periods, transmission is performed less frequently to save power and increase network capacity. For example, in GSM during active speech every speech frame, typically 20 ms in duration, is transmitted, whereas during silence periods, only every eighth speech frame is transmitted. Typically, active speech is encoded at a fixed bit rate and silence periods with a lower bit rate.

Multi-rate speech codecs, such as the adaptive multi-rate (AMR) codec and the adaptive multi-rate wideband (AMR-WB) codec were developed to include VAD/DTX functionality and are examples of fixed rate speech encoding. The bit rate of the speech encoding, also known as the codec mode, is based on factors such as the network capacity and radio channel conditions of the air interface.

AMR was developed by the 3$^{rd}$ Generation Partnership Project (3GPP) for GSM/EDGE and WCDMA communication networks. In addition, it has also been envisaged that AMR will be used in future packet switched networks. AMR is based on Algebraic Code Excited Linear Prediction (ACELP) coding. The AMR and AMR WB codecs consist of 8 and 9 active bit rates respectively and also include VAD/DTX functionality. The sampling rate in the AMR codec is 8 kHz. In the AMR WB codec the sampling rate is 16 kHz.

ACELP coding operates using a model of how the signal source is generated, and extracts from the signal the parameters of the model. More specifically, ACELP coding is based on a model of the human vocal system, where the throat and mouth are modelled as a linear filter and speech is generated by a periodic vibration of air exciting the filter. The speech is analysed on a frame by frame basis by the encoder and for each frame a set of parameters representing the modelled speech is generated and output by the encoder. The set of parameters may include excitation parameters and the coefficients for the filter as well as other parameters. The output from a speech encoder is often referred to as a parametric representation of the input speech signal. The set of parameters is then used by a suitably configured decoder to regenerate the input speech signal.

Details of the AMR and AMR-WB codecs can be found in the 3GPP TS 26.090 and 3GPP TS 26.190 technical specifications. Further details of the AMR-WB codec and VAD can be found in the 3GPP TS 26.194 technical specification. All the above documents are incorporated herein by reference.

Both AMR and AMR-WB codecs are multi rate codecs with independent codec modes or bit rates. In both the AMR and AMR-WB codecs, the mode selection is based on the network capacity and radio channel conditions. However, the codecs may also be operated using a variable rate scheme such as SBRA where the codec mode selection is further based on the speech class. The codec mode can then be selected independently for each analysed speech frame (at 20 ms intervals) and may be dependent on the source signal characteristics, average target bit rate and supported set of codec modes. The network in which the codec is used may also limit the performance of SBRA. For example, in GSM and GSM/EDGE, the codec mode can be changed only once every 40 ms. This effectively means that the mode can only be changed every two frames.

By using SBRA, the average bit rate may be reduced without any noticeable degradation in the decoded speech quality. The advantage of lower average bit rate is lower transmission power and hence higher overall capacity of the network.

Typical SBRA algorithms determine the speech class of the sampled speech signal based on speech characteristics. These speech classes may include low energy, transient, unvoiced and voice sequences. The subsequent speech encoding is dependent on the speech class. Therefore, the accuracy of the speech classification is important as it determines the speech encoding and associated encoding rate. In previously known systems, the speech class is determined before speech encoding begins.

The limitation discussed above relating to GSM/EDGE networks means that the full advantages of source based rate adaptation (SBRA) cannot be achieved in such networks. That is, because in a GSM/EDGE radio network, the codec mode can be changed only in every second frame, and then to only one of two adjacent modes, the performance of source based rate adaptation is crucially slowed down. This clearly has a reductive effect on the competence of the SBRA algorithm.

Reference is made to US 20030125932 (Microsoft) which discloses a codec mode selector which selects the codec mode for each frame on the basis of the classification of the current frame and statistical analysis of other frames in the sequence. A optimised target bit rate is set for each frame, and so it is inherent in the system described in US 20030125932 that it can only be implemented in a system where the target bit rate for each frame can be selected. Therefore it cannot be used in GSM/EDGE systems which have a limitation on codec mode changes.

It is also noted that the aim of the system described in US 20030125932 is to reduce the average bit rate of the coded bit stream, possibly at the expense of speech quality.

It is an aim of the present invention to improve speech quality, even in systems with codec mode change limitations.

SUMMARY OF THE INVENTION

According to an aspect of the present invention there is provided a method of determining a codec mode for encoding a frame in a communications system, the method comprising the steps of: receiving a sequence of signal samples arranged in frames; analysing a current frame to select a codec mode appropriate for the current frame; predicting the characteristics of a subsequent frame using lookahead samples from the subsequent frame; and determining a codec mode for the current frame and the subsequent frame which suits the current frame and also suits a subsequent frame based on the predicted characteristics.

Another aspect provides a method of encoding a frame in a communications system, the method comprising the steps of: receiving a sequence of signal samples arranged in frames; analysing a current frame to select a codec mode appropriate for the current frame; predicting the characteristics of a subsequent frame using lookahead samples which are stored for use in a subsequent signal encoding step; determining a codec mode for the current frame and the subsequent frame which suits the current frame and also suits the subsequent frame based on the predicted characteristics; and encoding the current frame and the subsequent frame using the determined codec mode.

A third aspect provides a communications system arranged to receive and encode frames according to determined codec modes, the system comprising: an input arranged to receive a sequence of signal samples arranged in frames; an analyser arranged to analyse the current frame to select a codec mode appropriate for the current frame; a predictor arranged to predict the characteristics of a subsequent frame using lookahead samples from the subsequent frame; and a codec mode selector arranged to select a codec mode for the current frame and the subsequent frame which suits the current frame and also suits the subsequent frame based on the predicted characteristics.

The step of predicting the characteristics can use lookahead samples which are already stored for use in a subsequent signal encoding step, for example in an LPC module.

The step of determining the codec mode can comprise selecting one mode from a plurality of available modes of predefined bit rates. For example, the bit rates can be 4.75, 5.9, 7.4 and 12.2 kbps.

It is an aim of the present invention to improve speech quality, if necessary at the expense of bit rate. In a preferred embodiment of the present invention therefore a high bit rate codec mode is selected for the current frame and for the subsequent frame in a situation where the codec mode appropriate for the current frame is a low bit rate codec mode, but where a high bit rate mode is needed for the subsequent frame, for example because of a transition in the signal in the subsequent frame.

The method can further comprise the step of detecting whether the communication system has limitations with the effect that a codec mode cannot be changed for the subsequent frame and to selectively use the determining step based on that detection.

The step of predicting the characteristics of a subsequent frame can be carried out based on the energy and frequency content of the lookahead samples.

The invention is particularly applicable in a GSM/EDGE system where the codec mode can be changed only in every other frame. Such a system also imposes the limitation that a codec mode can only be changed to an adjacent codec mode in the plurality of available modes. In such a system, the usage of codec modes can be taken into account in such a way as to limit use of the lowest bit rate mode and highest bit rate mode. That is, it is preferable to stay in the middle bit rates to make sure that there are always two possibilities available to change the mode in a system which is limited to switching only to an adjacent codec mode.

BRIEF DESCRIPTION OF DRAWINGS

For a better understanding of the present invention reference will now be made by way of example only to the accompanying drawings, in which.

DETAILED DESCRIPTION OF EMBODIMENTS

The present invention is described herein with reference to particular examples. The invention is not, however, limited to such examples.

Figure 1:
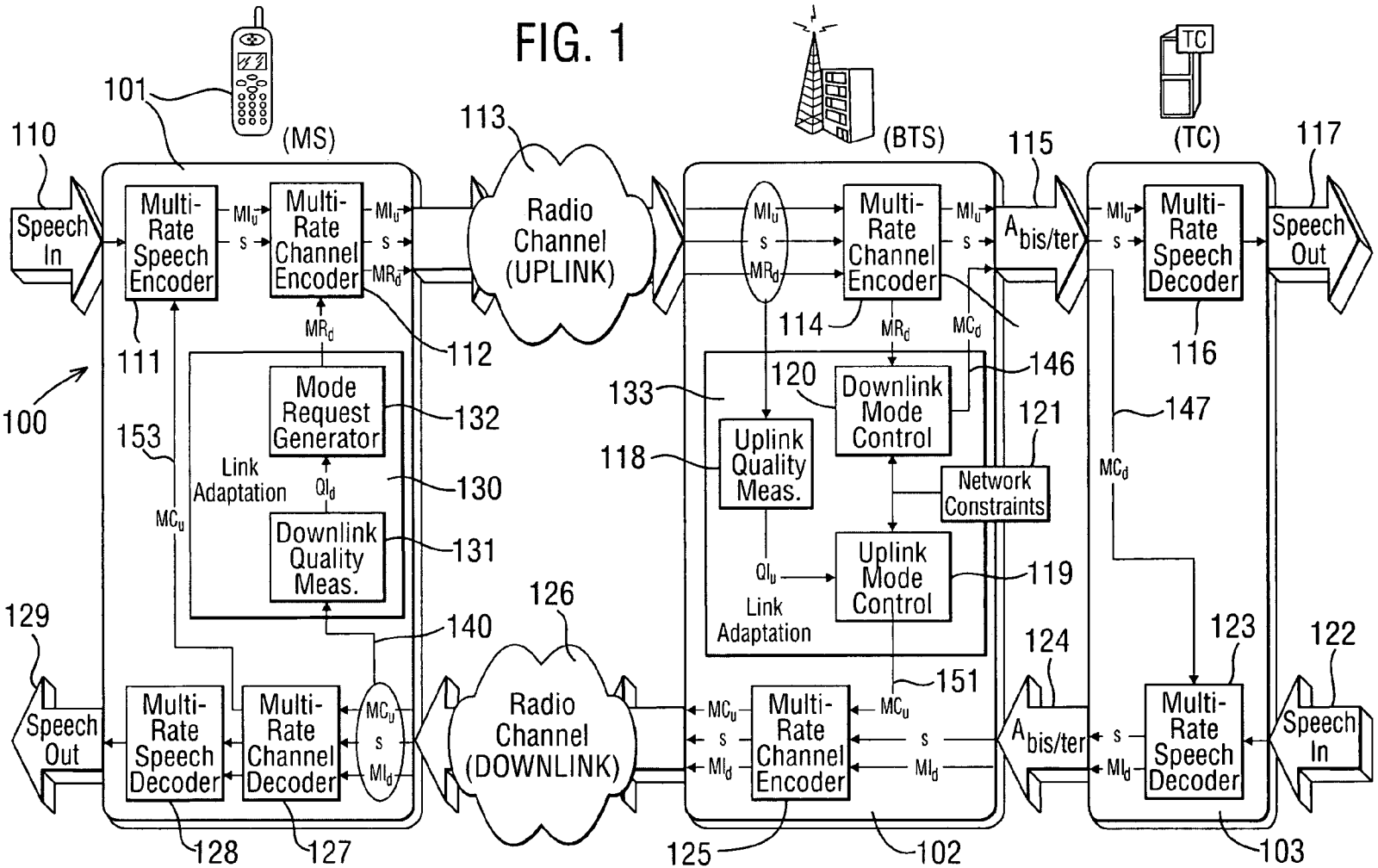
FIG. 1 illustrates a communication network in which embodiments of the present invention can be applied.

FIG. 1 illustrates a typical cellular telecommunication network 100 that supports an AMR speech codec. The network 100 comprises various network elements including a mobile station (MS) 101, a base transceiver station (BTS) 102 and a transcoder (TC) 103. The MS communicates with the BTS via the uplink radio channel 113 and the downlink radio channel 126. The BTS and TC communicate with each other via communication links 115 and 124. The BTS and TC form part of the core network. For a voice call originating from the MS, the MS receives speech signals 110 at a multi-rate speech encoder module 111.

In this example, the speech signals are digital speech signals converted from analogue speech signals by a suitably configured analogue to digital (A/D) converter (not shown). The multi-rate speech encoder module encodes the digital speech signal 110 into a speech encoded signal on a frame by frame basis, where the typical frame duration is 20 ms. The speech encoded signal is then transmitted to a multi-rate channel encoder module 112 together with an uplink codec mode indicator $MI_u$. The multi-rate channel encoder module further encodes the speech encoded signals from the multi-rate speech encoder module. The purpose of the multi-rate channel encoder module is to provide coding for error detection and/or error correction purposes. The encoded signals from the multi-rate channel encoder are then transmitted across the uplink radio channel 113 to the BTS, with the codec mode indicator. The encoded signal is received at a multi-rate channel decoder module 114, which performs channel decoding on the received signal. The channel decoded signal is then transmitted across communication link 115 to the TC 103. In the TC 103, the channel decoded signal is passed into a multi-rate speech decoder module 116, which decodes the input signal and outputs a digital speech signal 117 corresponding to the input digital speech signal 110.

A similar sequence of steps to that of a voice call originating from a MS to a TC occurs when a voice call originates from the core network side, such as from the TC via the BTS to the MS. When the voice calls starts from the TC, the speech signal 122 is directed towards a multi-rate speech encoder module 123, which encodes the digital speech signal 122. The speech encoded signals are transmitted from the TC to the BTS via communication link 124 with a downlink codec mode indicator $MI_d$.

At the BTS, it is received at a multi-rate channel encoder module 125. The multi-rate channel encoder module 125 further encodes the speech encoded signal from the multi-rate speech encoder module 123 for error detection and/or error correction purposes. The encoded signal from the multi-rate channel encoder module is transmitted across the downlink radio channel 126 to the MS. At the MS, the received signal is fed into a multi-rate channel decoder module 127 and then into a multi-rate speech decoder module 128, which perform channel decoding and speech decoding respectively. The output signal from the multi-rate speech decoder is a digital speech signal 129 corresponding to the input digital speech signal 122.

Link adaptation may also take place in the MS and BTS. Link adaptation selects the AMR multi-rate speech codec mode according to transmission channel conditions. If the transmission channel conditions are poor, the number of bits used for speech encoding can be decreased (lower bit rate) and the number of bits used for channel encoding can be increased to try and protect the transmitted information. However, if the transmission channel conditions are good, the number of bits used for channel encoding can be decreased and the number of bits used for speech encoding increased to give a better speech quality.

The MS may comprise a link adaptation module 130, which takes data 140 from the downlink radio channel to determine a preferred downlink codec mode for encoding the speech on the downlink channel. The data 140 is fed into a downlink quality measurement module 131 of the link adaptation module 130, which calculates a quality indicator message for the downlink channel, $QI_d$. $QI_d$ is transmitted from the downlink quality measurement module 131 to a mode request generator module 132 via connection 141. Based on $QI_d$, the mode request generator module 132 calculates a preferred codec mode for the downlink channel 126. The preferred codec mode is transmitted in the form of a codec mode request message for the downlink channel $MR_d$ to the multi-rate channel encoder 112 module via connection 142. The multi-rate channel encoder 112 module transmits $MR_d$ through the uplink radio channel to the BTS.

In the BTS, $MR_d$ may be transmitted via the multi-rate channel decoder module 114 to a link adaptation module 133. Within the link adaptation module in the BTS, the codec mode request message $MR_d$ for the downlink channel is translated into a codec mode request message $MC_d$ for the downlink channel. This function may occur in the downlink mode control module 120 of the link adaptation module 133. The downlink mode control module transmits $MC_d$ via connection 146 to communications link 115 for transmission to the TC.

In the TC, $MC_d$ is transmitted to the multi-rate speech encoder module 123 via connection 147. The multi-rate speech encoder module 123 can then encode the incoming speech 122 with the codec mode defined by $MC_d$. The encoded speech, encoded with the adapted codec mode defined by $MC_d$, is transmitted to the BTS via connection 124 and onto the MS as described above. Furthermore, the codec mode indicator message $MI_d$ for the downlink radio channel may be transmitted via connection 124 from the multi-rate speech encoder module 123 to the BTS and onto the MS, where it is used in the decoding of the speech in the multi-rate speech decoder 128 at the MS.

A similar sequence of steps to link adaptation for the downlink radio channel may also be utilised for link adaptation of the uplink radio channel. The link adaptation module 133 in the BTS may comprise an uplink quality measurement module 118, which receives data from the uplink radio channel and determines a quality indicator message, $QI_u$, for the uplink radio channel. $QI_u$ is transmitted from the uplink quality measurement module 118 to the uplink mode control module 119 via connection 150. The uplink mode control module 119 receives $QI_u$ together with network constraints from the network constraints module 121 and determines a preferred codec mode for the uplink encoding. The preferred codec mode is transmitted from the uplink control module 119 in the form of a codec mode command message for the uplink radio channel $MC_u$ to the multi-rate channel encoder module 125 via connection 151. The multi-rate channel encoder module 125 transmits $MC_u$ together with the encoded speech signal over the downlink radio channel to the MS.

In the MS, $MC_u$ is transmitted to the multi-rate channel decoder module 127 and then to the multi-rate speech encoder 111 via connection 153, where it is used to determine a codec mode for encoding the input speech signal 110. As with the speech encoding for the downlink radio channel, the multi-rate speech coder module for the uplink radio channel generates a codec mode indicator message for the uplink radio channel $MI_u$. $MI_u$ is transmitted from the multi-rate speech encoder control module 111 to the multi-rate channel encoder module 112, which in turn transmits $MI_u$ via the uplink radio channel to the BTS and then to the TC. $MI_u$ is used at the TC in the multi-rate speech decoder module 116 to decode the received encoded speech with a codec mode determined by $MI_u$.

Figure 2:
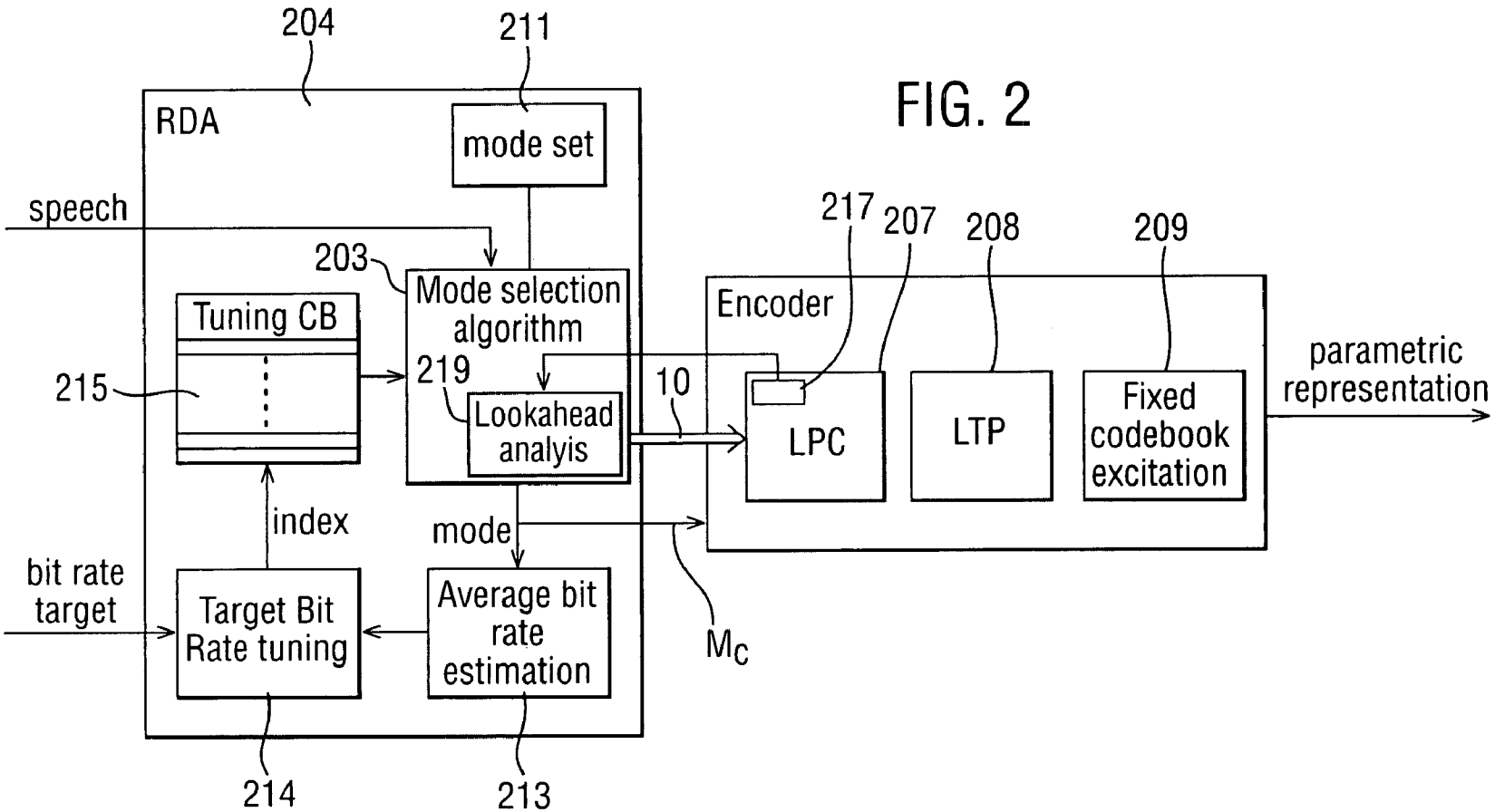
FIG. 2 illustrates a block diagram of an arrangement in accordance with an embodiment of the invention.

FIG. 2 illustrates a block diagram of the components of a multi-rate speech encoder module which could be used to implement modules 111 and 123 of FIG. 1. The multi-rate speech encoder module 111 includes an RDA module 204 for implementing the source based rate adaptation (SBRA) algorithm in module 203. The RDA module 204 comprises a mode set module 211, an average bit rate estimation module 213, a target bit rate tuning module 214 and a tuning CB module 215. In the RDA module 204, the bit rate of the speech codec can be adjusted based on the target bit rate. The average bit rate can be tuned continuously within a certain bit rate range using the tuning module 215. The bit rate can be tuned continuously, for example between 4.75 kbps to 12.2. kbps. The advantage is that network load can be tuned always at the maximum capacity offering the maximum speech quality for an arbitary number of mobile users. Therefore speech quality degradation can be minimised or even eliminated, even if the network capacity has increased. The RDA module 204 is connected to a speech encoder 206, which encodes the speech signal 10 received from the SBRA algorithm module with a codec mode $M_c$ based on the speech class selected by the SBRA algorithm 203. The speech encoder operates using Algebraic Code Excited Linear Prediction (ACELP) coding.

The speech encoder 206 in FIG. 2 comprises a linear prediction coding (LPC) calculation module 207, a long term prediction (LTP) calculation module 208 and a fixed code book excitation module 209. The speech signal is processed by the LPC calculation module, LTP calculation module and fixed code book excitation module on a frame by frame basis, where each frame is typically 20 ms long. The output of the speech encoder consists of a set of parameters representing the input speech signal.

Specifically, the LPC calculation module 207 determines the LPC filter corresponding to the input speech frame by minimising the residual error of the speech frame. Once the LPC filter has been determined, it can be represented by a set of LPC filter coefficients for the filter. The filter coefficients are determined using an autocorrelation approach with 30 ms asymmetric windows, and can be performed once or twice per speech frame. For all speech modes except 12.2 kbps, a lookahead of 40 samples (5 ms) is used in the autocorrelation computation. These samples are held in a lookahead buffer 217 which is shown located in the LPC calculation module 207 but which could alternatively be located in the RDA module 204.

The LPC filter coefficients are quantized by the LPC calculation module before transmission. The main purpose of quantization is to code the LPC filter coefficients with as few bits as possible without introducing additional spectral distortion. Typically, LPC filter coefficients, $(a_1, \ldots, a_p)$, are transformed into a different domain, before quantization. This is done because direct quantization of the LPC filter, specifically an infinite impulse response (IIR) filter, coefficients may cause filter instability. Even slight errors in the IIR filter coefficients can cause significant distortion throughout the spectrum of the speech signal.

The LPC calculation module converts the LPC filter coefficients into the immitance spectral pair (ISP) domain before quantization. However, the ISP domain coefficients may be further converted into the immitance spectral frequency (ISF) domain before quantization.

The LTP calculation module 208 calculates an LTP parameter from the LPC residual. The LTP parameter is closely related to the fundamental frequency of the speech signal and is often referred to as a "pitch-lag" parameter or "pitch delay" parameter, which describes the periodicity of the speech signal in terms of speech samples. The pitch-delay parameter is calculated by using an adaptive codebook by the LTP calculation module.

A further parameter, the LTP gain is also calculated by the LTP calculation module and is closely related to the fundamental periodicity of the speech signal. The LTP gain is an important parameter used to give a natural representation of the speech. Voiced speech segments have especially strong long-term correlation. This correlation is due to the vibrations of the vocal cords, which usually have a pitch period in the range from 2 to 20 ms.

The fixed code book excitation module 209 calculates the excitation signal, which represents the input to the LPC filter. The excitation signal is a set of parameters represented by innovation vectors with a fixed codebook combined with the LTP parameter. In a fixed codebook, algebraic code is used to populate the innovation vectors. The innovation vector contains a small number of nonzero pulses with predefined interlaced sets of potential positions. The excitation signal is sometimes referred to as algebraic codebook parameter.

The output from the speech encoder 210 in FIG. 2 is an encoded speech signal represented by the parameters determined by the LPC calculation module, the LTP calculation module and the fixed code book excitation module, which include:

1. LPC parameters quantised in ISP domain describing the spectral content of the speech signal;
2. LTP parameters describing the periodic structure of the speech signal;
3. ACELP excitation quantisation describing the residual signal after the linear predictors.
4. Signal gain.

The bit rate of the codec mode used by the speech encoder may affect the parameters determined by the speech encoder. Specifically, the number of bits used to represent each parameter varies according to the bit rate used. The higher the bit rate, the more bits may be used to represent some or all of the parameters, which may result in a more accurate representation of the input speech signal.

The above described RDA module 204 allows speech codec mode selection to be done without any limitations. The used mode can be arbitrarily selected from the active codec set for each encoded frame. However, this advantage cannot be utilised fully in GSM/EDGE radio networks. In GSM/EDGE radio networks, modes can be changed only in every second frame because of limited inbound signalling capacity. In addition, the mode currently being used can only be changed to a neighbouring mode in the active mode set, in order to improve the robustness of the mode decoding. For example, if the active mode set includes the modes 4.75, 5.9, 7.4 and 12.2 kbps, and the used mode in the previous frame was 5.9 kbps, the mode for the next two speech frames must be selected from one of the following modes: 4.75, 5.9 and 7.4 kbps. These GSM/EDGE limitations crucially slow down the performance of source based rate adaptation.

The described embodiment of the present invention illustrates a solution to this problem. The solution rests in using the lookahead buffer 217 which is provided for use by the LPC module 207. As described above, the lookahead contained in the lookahead buffer 217 includes 40 samples (5 ms) of the next incoming speech frame and is used by the LPC module for windowing purposes. Even though the samples are not used in the 12.2 kbps mode by the LPC module, it is nevertheless available in that buffer.

The lookahead samples in the lookahead buffer 217 are utilised in accordance with the described embodiment of the present invention by a lookahead analysis algorithm 219 to improve the performance of SBRA AMR speech codec in GSM/EDGE radio networks. The lookahead analysis examines the characteristic of the first 40 samples of the next frame by observing the energy and frequency content. Based on the fact that the lookahead buffer 217 contains the first sub-frame of the next frame, it is assumed to be a prediction about the characteristic of the next frame. Recall that in GSM, the speech mode can be changed only in every second frame. By looking ahead to the next incoming frame, a judgement can be made about the speech mode for the current frame to provide the best compromise for coding across the current frame and the subsequent frame, taking into account the GSM limitation that the speech mode can be changed only in every second frame.

Figure 3:
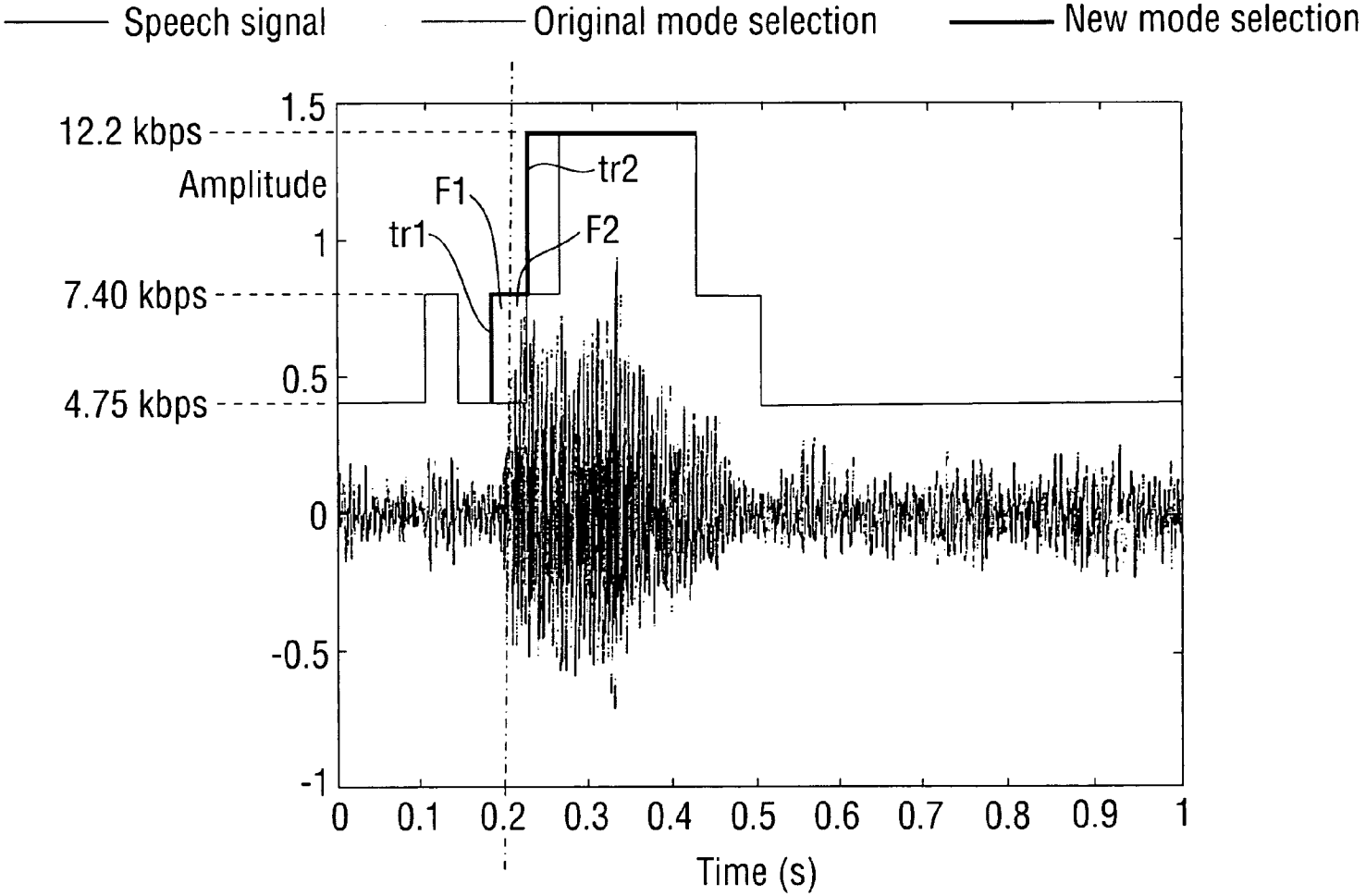
FIG. 3 is a graph showing the effect of lookahead analysis.

FIG. 3 illustrates an example. FIG. 3 is a graph of amplitude (on the y axis) versus time (on the x axis). The signal in an unbroken line in FIG. 3 is the speech signal. Consider the situation on either side of the time T=0.2 seconds line which is marked vertically in FIG. 3. The frame F1 is marked on the left hand side of that line and the frame F2 is on the right hand side of that line. In the prior art system, the 4.75 kbps mode for the frame F1 is kept in place on the characteristics of that frame which does not include an transient information. The next speech frame F2 includes a sudden transient which ideally should be coded by the higher speech mode to avoid speech quality degradation. However, according to the prior art, the mode cannot be switched back to the highest speech mode on the next frame (remember that in GSM/EDGE systems a mode change can only be made every two frames). Thus, the mode F2 has to remain at 4.75 kbps, resulting in speech quality degradation.

According to the described embodiment of the present invention, however, the following sequence occurs. The lookahead analysis 219 takes account the characteristics of the frame F2 when examining the characteristics of the frame F1 to determine the speech mode. In this particular case, it is detected that the mode F2 contains a transient and so the mode is changed towards higher speech mode, which is 7.40 kbps for both F1 and F2 frames. Thus, the transition tr1 takes place. Subsequently, in analysing the mode for the frame F3, the characteristics of the frame F4 are taken into account. Note that frames F3 and F4 are not shown in FIG. 3, but follow consecutively from frames F1 and F2. In this case, the highest mode can be switched at transition tr2 for both F3 and F4 frames, therefore speech quality degradation can be avoided in the described speech sequence. In the prior art case, frames F3 and F4 are coded by 7.40 kbps and the highest speech mode (12.2 kbps) cannot be switched until frames F5 and F6. Therefore, mode change is late in the prior art case, which causes speech quality degradation.

The only disadvantage of the present invention is that a slightly higher bit rate than is absolutely necessary is used for some frames, for example F1 in the presently described case. However, that is more than offset by the dramatic improvement in speech quality and intelligibility achieved by detecting the start of the transients.

The transients can be detected in the lookahead analysis 219 by comparing energy levels of the lookahead frame and the current speech frame. If the difference is above a predetermined threshold, the transient sequence is detected as present.

Figure 4:
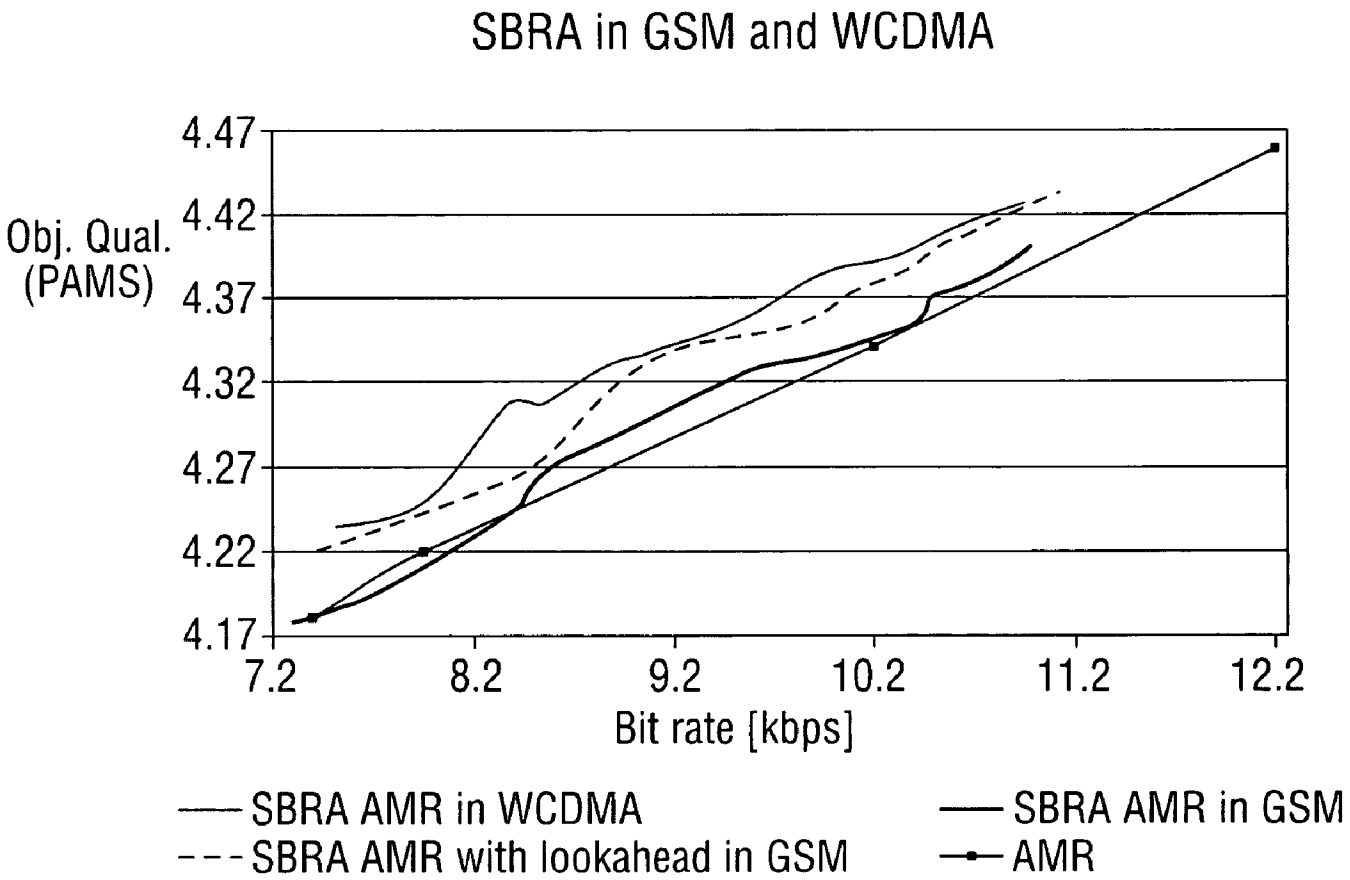
FIG. 4 is a graph following a test showing the improvement to be gained by the invention.

FIG. 4 illustrates a test which was conducted objectively using a perceptual analysis measurement system (PAMS). It can be seen from FIG. 4 that lookahead analysis improves the performance of SBRA (AMR) with GSM limitations.

In the described embodiment, the lookahead buffer 217 is located in the LPC module, and the lookahead buffer information is sent to the mode selection algorithm where the lookahead analysis is carried out. Alternatively, it would be possible to locate the lookahead buffer in the RDA or in any other suitable location.

What is claimed is:

1. A method of determining a codec mode for encoding a frame in a communications system, the method comprising the steps of:

receiving a sequence of signal samples arranged in frames;

analyzing a current frame to select a codec mode appropriate for the current frame;

predicting characteristics of a subsequent frame using lookahead samples from the subsequent frame; and determining a codec mode for the current frame and the subsequent frame which suits the current frame and also suits the subsequent frame based on the predicted characteristics.

2. A method according to claim 1, wherein the step of predicting the characteristics uses lookahead samples which are stored for use in a subsequent signal encoding step.

3. A method according to claim 1, wherein the step of determining the codec mode comprises selecting one mode from a plurality of available modes of predefined bit rates.

4. A method according to claim 3, wherein the step of determining a codec mode comprises the step of selecting a high bit rate mode for the current frame and the subsequent frame in a situation where the codec mode appropriate for the current frame is a low bit rate codec mode.

5. A method according to claim 3, wherein a codec mode can only be changed to an adjacent codec mode in said plurality of available modes.

6. A method according to claim 5, comprising the step of taking into account usage of codec modes when selecting a codec mode appropriate for the current frame in such a way as to limit use of the lowest bit rate mode and the highest bit rate mode.

7. A method according to claim 1, further comprising a step of detecting whether the communication system has limitations wherein a codec mode cannot be changed for the subsequent frame and selectively using the determining step based on that detection.

8. A method according to claim 7, wherein the codec mode can be changed only in every other frame.

9. A method according to claim 1, wherein the step of predicting the characteristics of a subsequent frame is carried out based on energy and frequency content of the lookahead samples.

10. A method of encoding a frame in a communications system, the method comprising the steps of:

receiving a sequence of signal samples arranged in frames;

analyzing a current frame to select a codec mode appropriate for a current frame;

predicting characteristics of a subsequent frame using lookahead samples which are stored for use in a subsequent signal encoding step;

determining a codec mode for the current frame and the subsequent frame which suits the current frame and also suits the subsequent frame based on predicted characteristics; and encoding the current frame and the subsequent frame using the determined codec mode.

11. A a speech encoding apparatus arranged to receive and encode frames according to determined codec modes, the system comprising:

an input arranged to receive a sequence of signal samples arranged in frames;

an analyzer arranged to analyze a current frame to select a codec mode appropriate for the current frame;

a predictor arranged to predict characteristics of a subsequent frame using lookahead samples from the subsequent frame; and a codec mode selector configured to select a codec mode for the current frame and the subsequent frame which suits the current frame and also suits the subsequent frame based on predicted characteristics.

12. A speech encoding apparatus according to claim 11, wherein the analyzer, predictor and codec mode selector comprises a source based rate adaptation module in a multi-rate speed codec apparatus.

13. A mobile communications network, comprising:

a network entity arranged to receive and encode frames according to determined codec modes, the entity comprising an input arranged to receive a sequence of signal samples arranged in frames, an analyzer arranged to analyze a current frame to select a codec mode appropriate for the current frame, a predictor arranged to predict characteristics of a subsequent frame using look ahead samples from the subsequent frame, and a codec mode selector configured to select a codec mode for the current frame and the subsequent frame which suits the current frame and also suits the subsequent frame based on predicted characteristics.

14. A system for determining a codec mode for encoding a frame, said system comprising:

receiving means for receiving a sequence of signal samples arranged in frames;

analyzing means for analyzing a current frame to select a codec mode appropriate for the current frame;

predicting means for predicting characteristics of a subsequent frame using lookahead samples from the subsequent frame; and determining means for determining a codec mode for the current frame and the subsequent frame which suits the current frame and also suits the subsequent frame based on the predicted characteristics.

15. A system for encoding a frame, said system comprising:

receiving means for receiving a sequence of signal samples arranged in frames;

analyzing means for analyzing a current frame to select a codec mode appropriate for a current frame;

predicting means for predicting characteristics of a subsequent frame using lookahead samples which are stored for use in a subsequent signal encoding step;

determining means for determining a codec mode for the current frame and the subsequent frame which suits the current frame and also suits the subsequent frame based on predicted characteristics; and encoding means for encoding the current frame and the subsequent frame using the determined codec mode.

16. A communications system arranged to receive and encode frames according to determined codec modes, said system comprising:

receiving means for receiving a sequence of signal samples arranged in frames;

analyzing means for analyzing a current frame to select a codec mode appropriate for the current frame;

prediction means for predicting characteristics of a subsequent frame using lookahead samples from the subsequent frame; and selection means for selecting a codec mode for the current frame and the subsequent frame which suits the current frame and also suits the subsequent frame based on predicted characteristics.

17. A network entity arranged to receive and encode frames according to determined codec modes, the entity comprising:

an input arranged to receive a sequence of signal samples arranged in frames;

an analyzer arranged to analyze a current frame to select a codec mode appropriate for the current frame;

a predictor arranged to predict characteristics of a subsequent frame using look ahead samples from the subsequent frame; and a codec mode selector configured to select a codec mode for the current frame and the subsequent frame which suits the current frame and also suits the subsequent frame based on predicted characteristics.

18. A network entity according to claim 17, comprising a mobile terminal.

19. A computer program embodied in a computer-readable medium, said computer program comprising a code sequence which, when executed on a computer, implements a method of determining a codec mode for encoding a frame comprising the steps of:

receiving a sequence of signal samples arranged in frames;

analyzing a current frame to select a codec mode appropriate for the current frame;

predicting characteristics of a subsequent frame using look ahead samples from the subsequent frame; and determining a codec mode for the current frame and the subsequent frame which suits the current frame and also suits the subsequent frame based on the predicted characteristics.

* * * * *